US007134809B2

(12) United States Patent
Hall et al.

(10) Patent No.: US 7,134,809 B2
(45) Date of Patent: Nov. 14, 2006

(54) OFFSHORES STRUCTURE SUPPORT

(75) Inventors: Rudolph A. Hall, Madison, LA (US); Ralph L. Shaw, New Orleans, LA (US)

(73) Assignee: Keystone Engineering Inc., Metairie, LA (US)

( * ) Notice: Subject to any disclaimer, the term of this patent is extended or adjusted under 35 U.S.C. 154(b) by 0 days.

(21) Appl. No.: 11/054,948

(22) Filed: Feb. 11, 2005

(65) Prior Publication Data

US 2005/0135881 A1 Jun. 23, 2005

Related U.S. Application Data

(63) Continuation of application No. 10/866,039, filed on Jun. 14, 2004, which is a continuation of application No. 10/147,926, filed on May 20, 2002, now Pat. No. 6,783,305.

(60) Provisional application No. 60/291,637, filed on May 18, 2001.

(51) Int. Cl.
*E02D 5/22* (2006.01)

(52) U.S. Cl. ..... 405/227; 405/224; 248/164

(58) Field of Classification Search ..... 248/164, 248/431, 188.1, 188.7, 163.1; 405/224, 227, 405/228

See application file for complete search history.

(56) References Cited

U.S. PATENT DOCUMENTS

| | | | | |
|---|---|---|---|---|
| 2,710,733 A | | 6/1955 | Phillips | |
| 3,643,447 A | | 2/1972 | Pogonowski | |
| 3,745,777 A | | 7/1973 | Blenkarn | |
| 3,805,534 A | | 4/1974 | Brasted | |
| 3,974,657 A | | 8/1976 | Sumner | |
| 4,723,875 A | | 2/1988 | Sutton | |
| 4,740,107 A | * | 4/1988 | Casbarian et al. | 405/211 |
| 4,917,541 A | * | 4/1990 | Carruba | 405/227 |
| 4,973,198 A | | 11/1990 | Cox | |
| 5,029,795 A | | 7/1991 | Dexter | |
| 5,051,036 A | | 9/1991 | Gomez De Rosas et al. | |
| 5,669,735 A | | 9/1997 | Blandford | |
| 5,722,494 A | * | 3/1998 | Landeck et al. | 175/7 |
| 5,851,052 A | | 12/1998 | Gustafsson | |
| 5,899,639 A | * | 5/1999 | Simmons | 405/227 |
| 5,988,949 A | * | 11/1999 | Will | 405/204 |
| 6,039,507 A | * | 3/2000 | Kennelly et al. | 405/227 |
| 6,299,385 B1 | | 10/2001 | Barnes | |
| 6,783,305 B1 | | 8/2004 | Hall et al. | |

FOREIGN PATENT DOCUMENTS

| | | |
|---|---|---|
| FR | 1 450 410 A | 6/1966 |
| GB | 1 395 297 A | 5/1975 |

* cited by examiner

*Primary Examiner*—Kimberly Wood
*Assistant Examiner*—Steven Marsh
(74) *Attorney, Agent, or Firm*—Nixon Peabody LLP; Donald R. Studebaker

(57) ABSTRACT

A pile based braced caisson structural support device includes a number of legs. These legs are configured in a teepee type configuration such that the footprint of the base is larger than the footprint of the opposing end. This structural support can be used as a base for an offshore drilling platform in that the support reduces the lateral forces on the support caused by wave action.

5 Claims, 26 Drawing Sheets

OFFSHORES STRUCTURE SUPPORT

RELATED APPLICATION DATA

This application claims the benefit of and priority under 35 U.S.C. §119(e) to U.S. Provisional Patent Application Ser. No. 60/291,637, filed May 18, 2001, entitled "Offshore Platform," which is incorporated herein by reference in its entirety.

BACKGROUND OF THE INVENTION

1. Field of the Invention

This invention generally relates to structural supports. In particular, this invention relates to structural supports for, for example, offshore drilling platforms, or the like.

2. Description of Related Art

Conventional offshore platforms have deck legs that are vertical or are battered outward as they extend downwards. The conventional arrangement provides structurally efficient support for the deck but the associated dimensions of the platform at the water surface result in increased expense for the platform.

SUMMARY OF THE INVENTION

Pile are configured in a "teepee" type configuration, where the piles are arranged to generally form a conical shape with their intersection being approximately at the elevation of, for example, a waterline. The tops of the piles extend pass this intersection to support, for example, a platform or structure, such as a drilling platform. The opposite ends of the piles are proportionally spaced on or below another surface, such as the mudline on an ocean floor.

The basic concept of using conical spaced piles can be extended such that two or more piles can be used to support, for example, a structure at a first end, while also providing support for, for example, a central member, such as a drill pipe, that extends through a central axis of the assembly. However, it is to be appreciated, that three or more piles can be used without a center member to support a structure as discussed above. Furthermore, two or more supports can be used with one or more center members to also support a structure as discussed above.

For example, two piles can be offset substantially 180° from each other, e.g. X shaped, three piles offset substantially 120° from each other, four piles offset substantially 90° from each other, e.g, teepee shaped, or the like. However, it is to be appreciated that the specific offset between the piles, and the number of piles, can be varied depending on, for example, expectant forces on the structure, the topology of the surface the assembly is to be secured to, the weight, structure and anticipated forces of the device that sits on top of the piles, or like.

An aspect of the invention relates to providing a structure support with at least three legs that are positioned in a teepee configuration.

Aspects of the present invention also relate to providing a structure support with four or more legs positioned in a teepee configuration.

Accordingly, an aspect of the invention allows piles to be configured such that the footprint has a greater surface area than the area formed by the opposing ends of piles.

Additional aspects of the invention related to minimizing the bracing required for a structural support in a wave zone.

Aspect of the invention additionally relate to a support structure that reduces lateral wave forces on the structure.

Aspects of the invention additionally relate to providing a structure in which the majority of the components can be installed and welded in-place above a waterline.

Aspects of the invention also relate to reducing drilling platform size.

These any other features and advantages of this invention are described in or are apparent from the following detailed description of the embodiments.

BRIEF DESCRIPTION OF THE DRAWINGS

The embodiments of the invention will be described in detail, with reference to the following figures, wherein.

DETAILED DESCRIPTION OF THE INVENTION

The exemplary embodiments of this invention will be described in relation to a support structure, such as drilling platform, supported by three piles and a central vertical member, such as drill pipe. However, to avoid unnecessarily obscuring the present invention, the following description omits well-known structures and devices that may be shown in block diagram form or otherwise summarized. For the purposes of explanation, numerous specific details are set forth in order to provide a thorough understanding of the present invention. It should be appreciated that the present invention may be practiced in a variety of ways beyond these specific details. For example, the systems and methods of this invention can be generally expanded and applied to support any type of structure. Furthermore, while exemplary distances and scales are shown in the figures, it is to be appreciated the systems and methods of this invention can be varied to fit any particular implementation.

Figure 1:
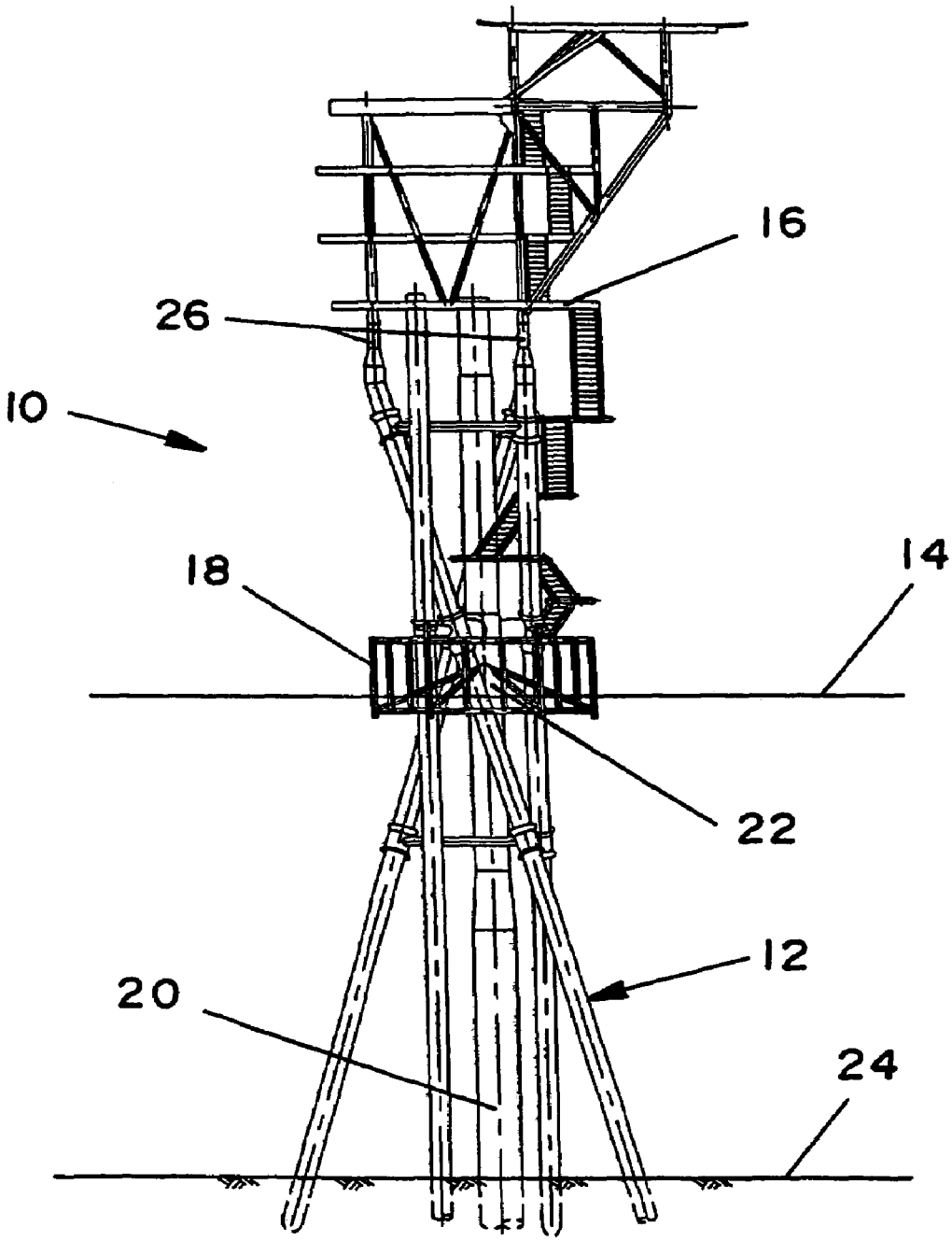
FIG. 1 is a view in side elevation Of an offshore platform of according to the present invention.
Figure 2:
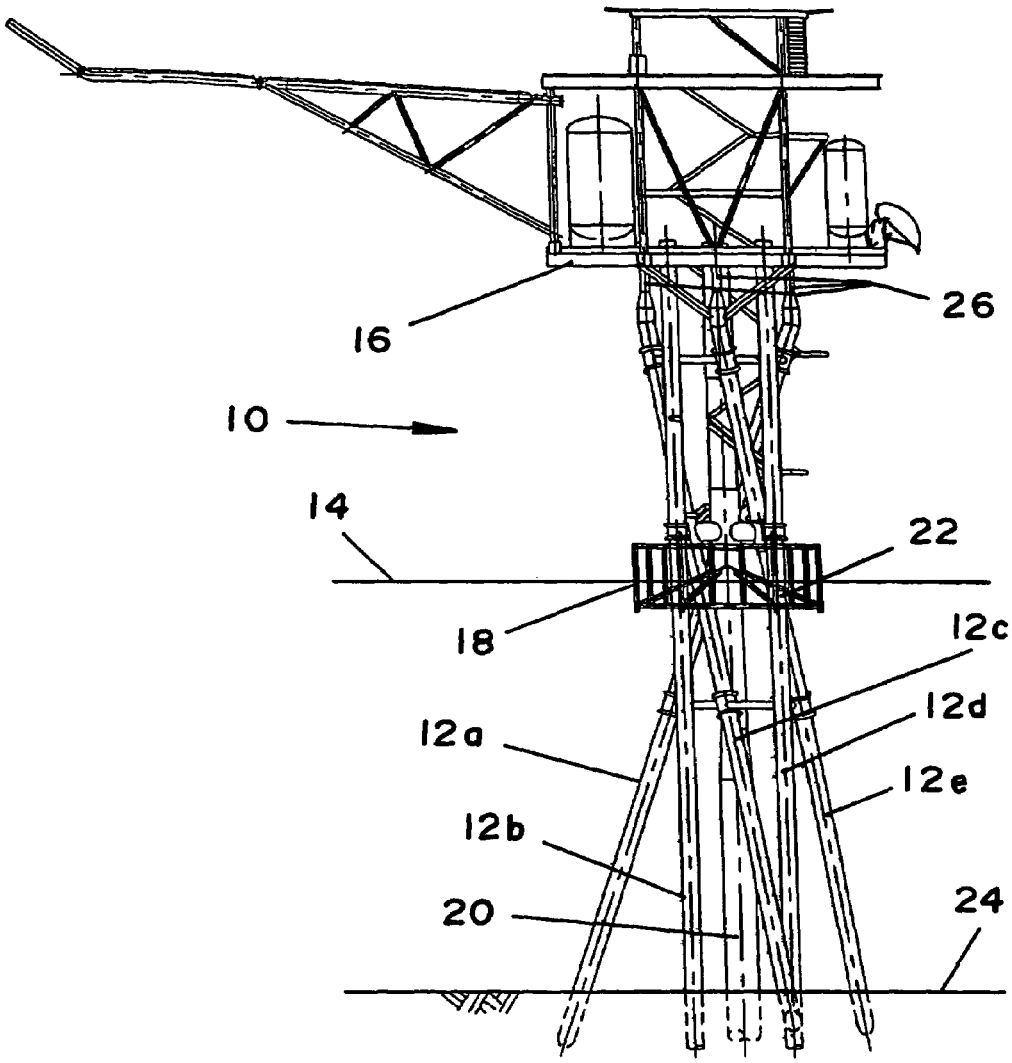
FIG. 2 is a view in front elevation of the offshore platform according to the present invention.

FIGS. 1 and 2 show an inward batter guide offshore platform indicated generally at 10 in which battered bracing piles 12*a*–*e* are arranged so as to minimize platform dimensions at the water surface 14 while maximizing the spacing of the piles as they extend upward from the water surface so that loads from a deck 16 at the top of the piles are transferred directly to the piling. The platform includes a pile guide structure 18 which fits over and is connected to a central vertical member 20 to receive the piles 12*a*–*e* at the water surface. The piles extend angularly through guides 22 of the pile guide structure in such a manner that the distance between piles is minimized at the water surface, but the distances between angled piles is maximized both at the ends supporting the deck 16 as well as at the opposed end buried below the mudline 24. The pile guide connects the piles to act in unison to restrain lateral movement of the entire offshore platform 10 including the central vertical member 20. The pile guide 18 also supports appurtenances such as ladders, boat landings, stairs, or the like, so that they can be installed in the field as a unit, thereby, for example, reducing installation expense for the platform. The legs 26 of the deck structure are connected to the tops of the piles. The increased pile spacing at the pile tops provides, for example, more structurally efficient support for the deck, reduced structural vibration periods for the platform and increased resistance to the rotation that results if the deck mass is eccentric to the central vertical member 20 than if the deck is supported by the central member. All field connections can be made above the water surface where structural integrity of the connections can be more easily verified than if the connections were made below the water surface.

Figure 3:
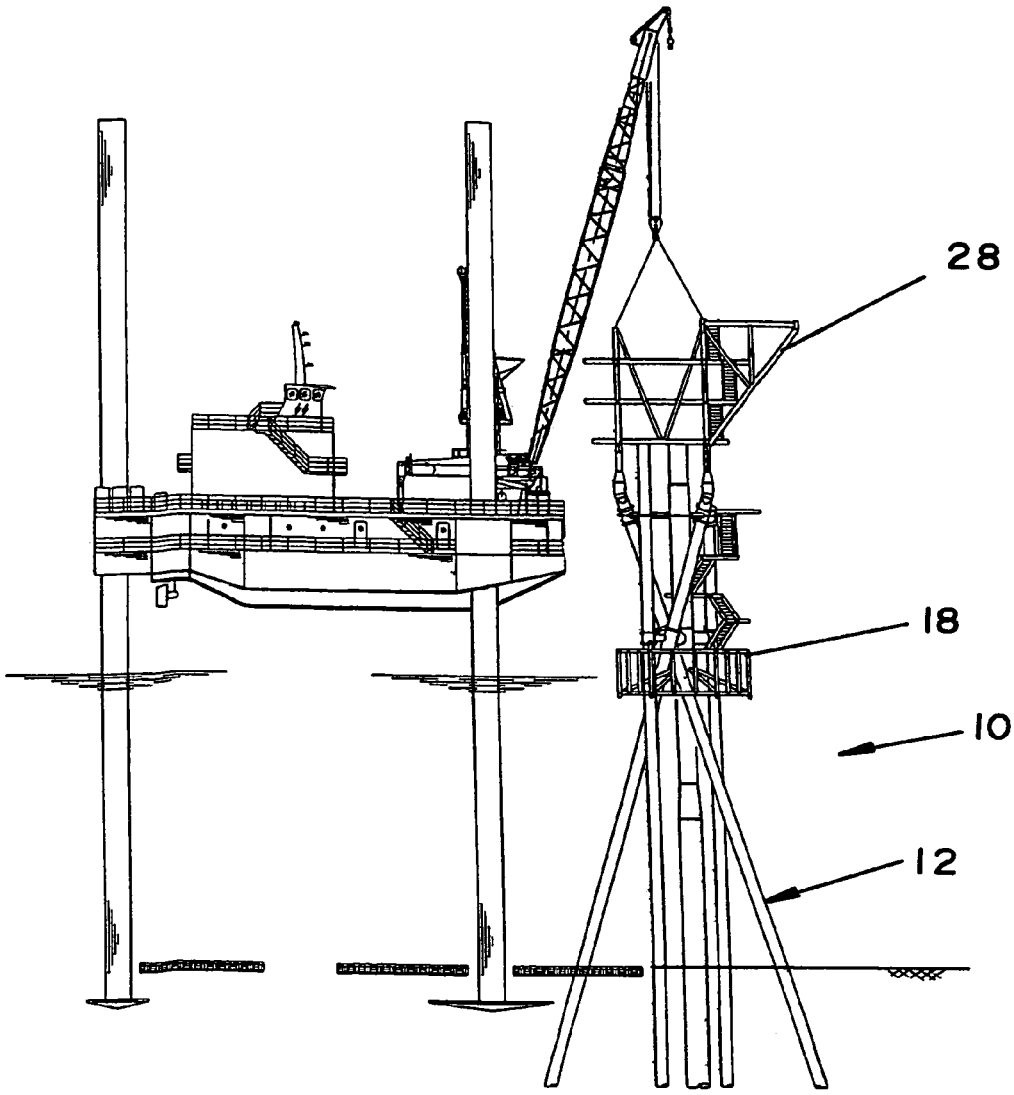
FIG. 3 is a view in side elevation showing the setting of the deck frame for the offshore platform according to the present invention.
Figure 4:
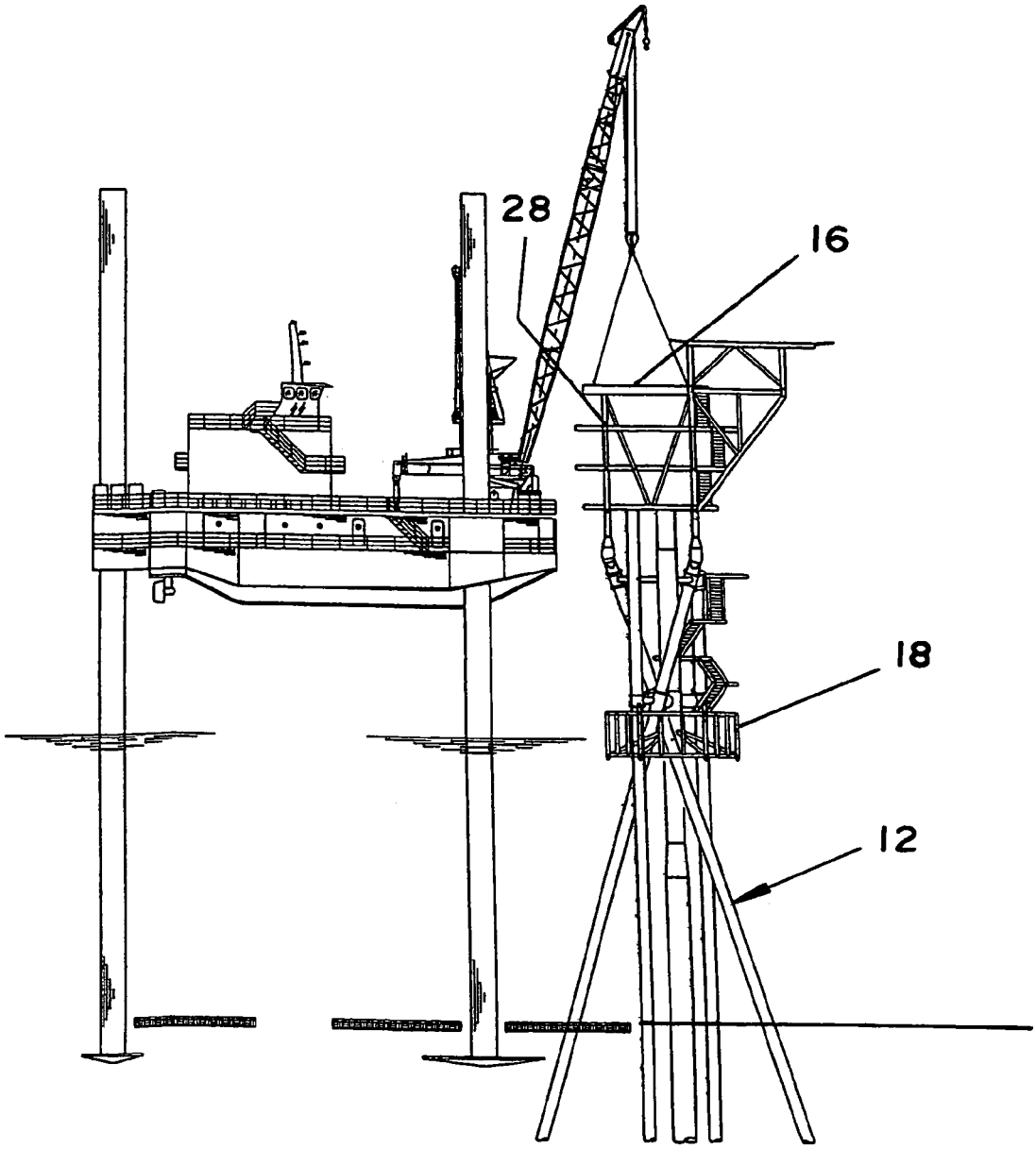
FIG. 4 is a view in side elevation showing the setting of the main deck for the offshore platform according to the present invention.
Figure 5:
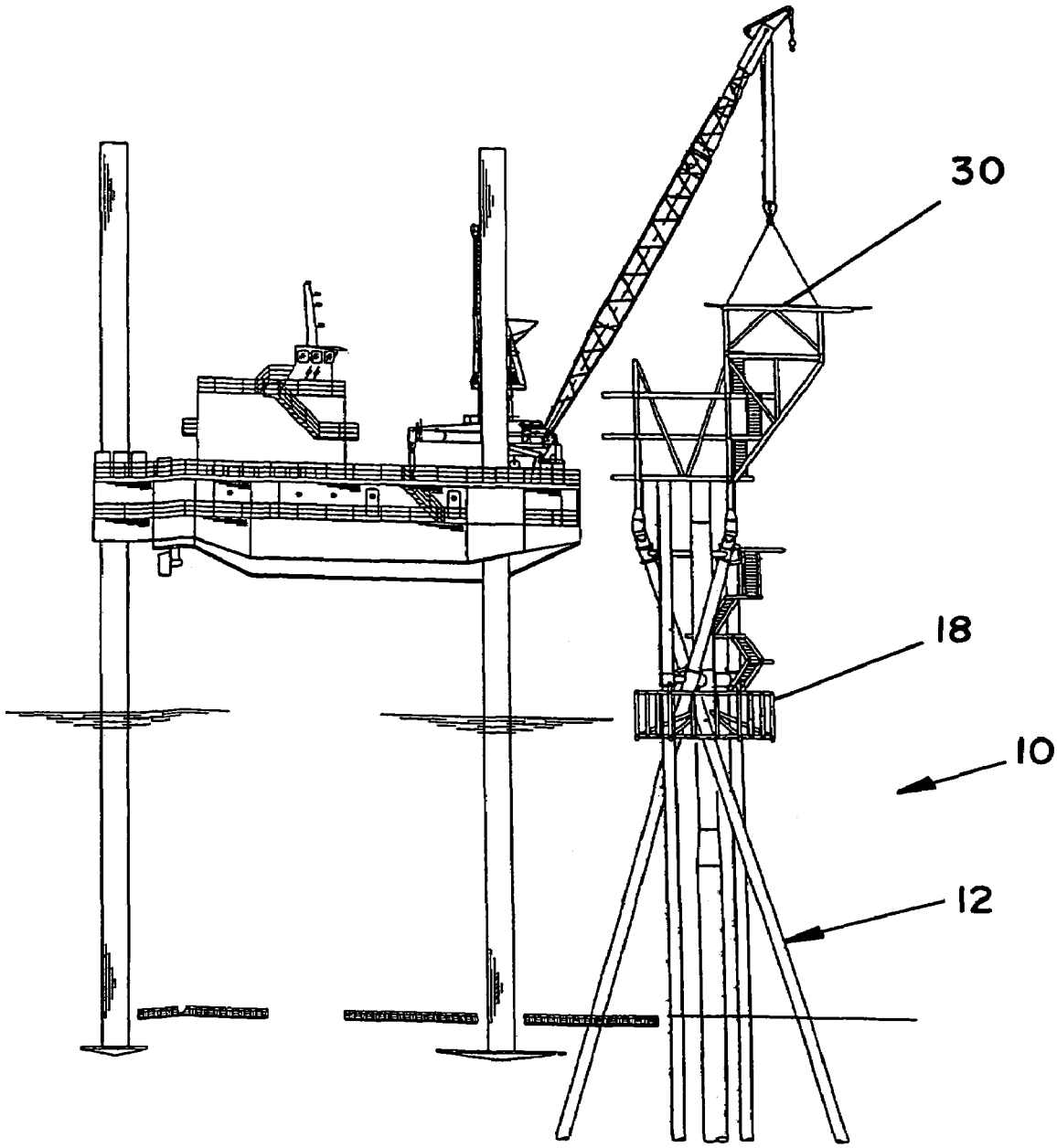
FIG. 5 is a view in side elevation showing the setting of the helideck for the offshore platform according to the present invention.

With reference to FIG. 3, once the piles 12 are in place, the deck frame 28 can be set on top of the piles and connected to the upper ends of the piles. Then, as shown in FIG. 4, the main deck 16 is set on the deck frame, and finally, as shown by FIG. 5, a helideck 30 is set in place.

Figure 6:
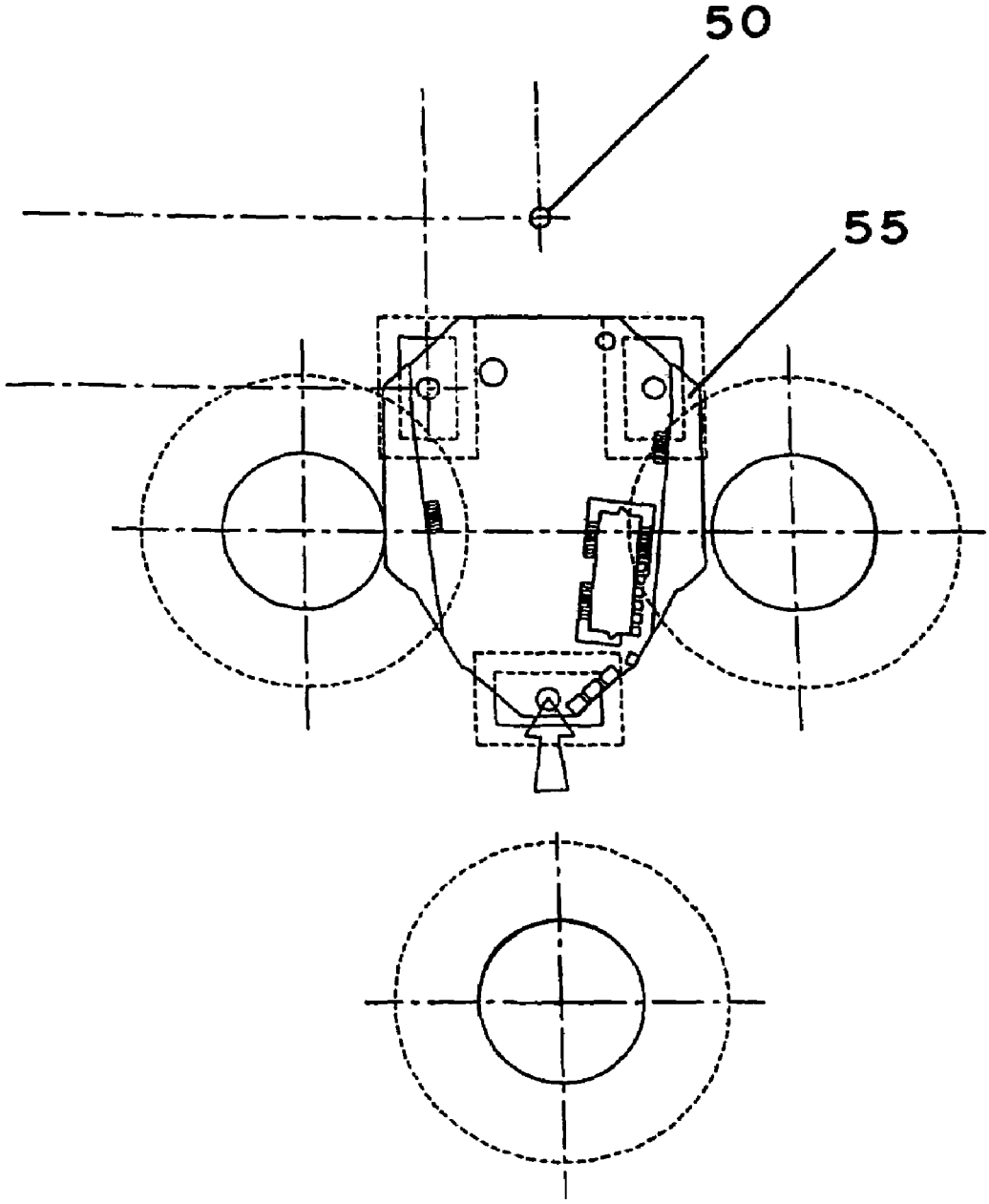
FIGS. 6–19 illustrate an exemplary method of assembling a braced caisson according to this invention.
Figure 7:
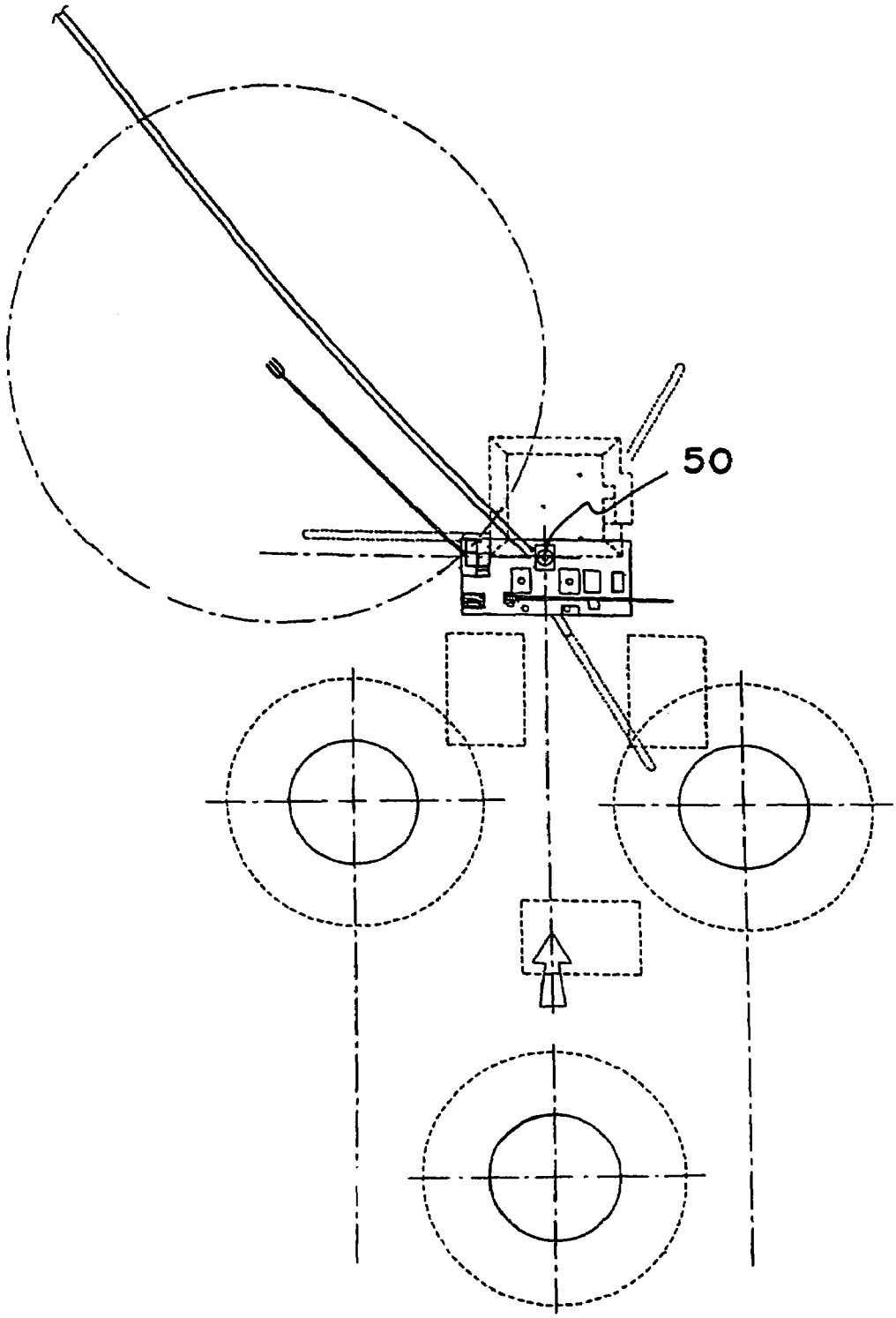
Figure 8:
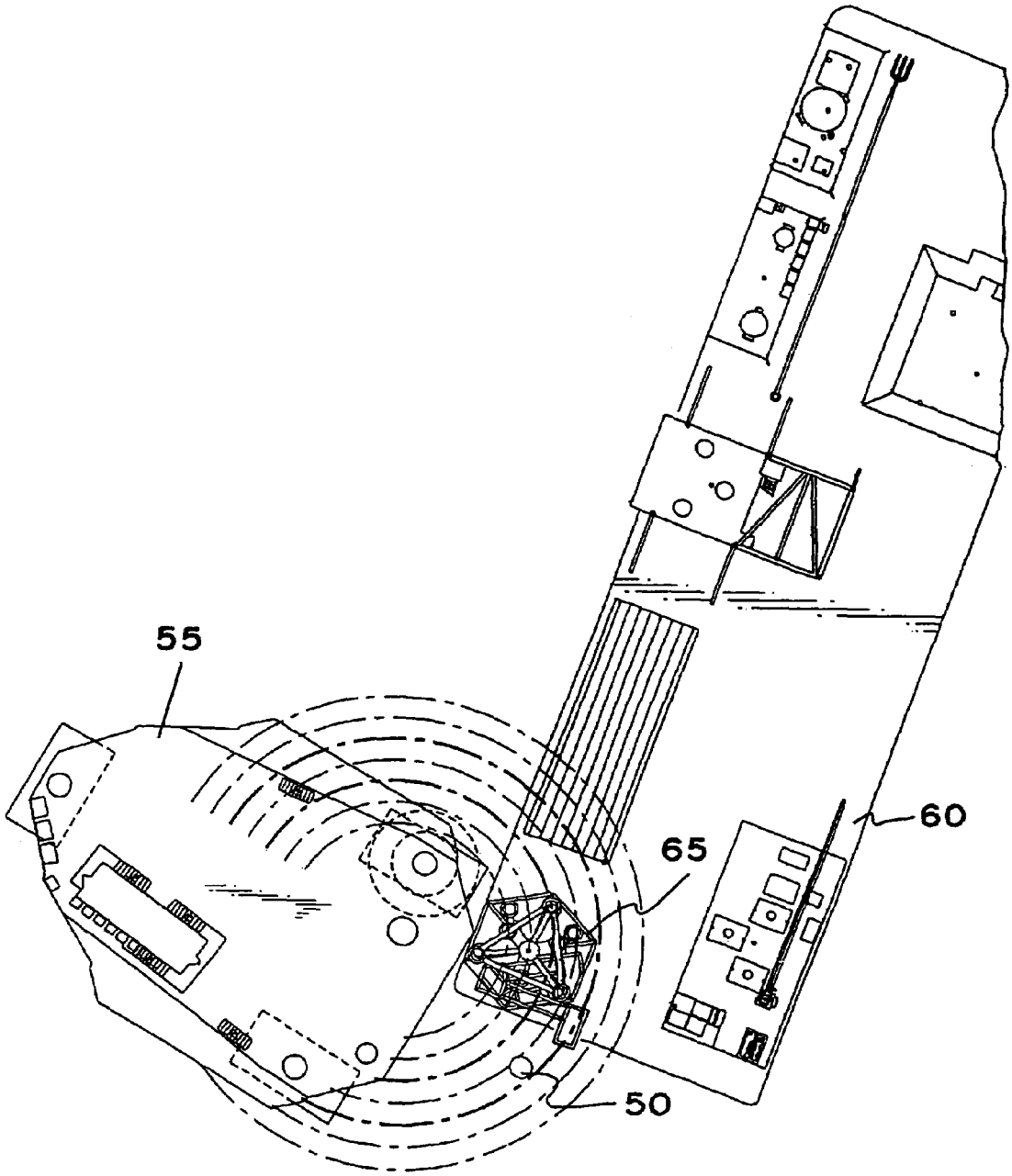
Figure 9:
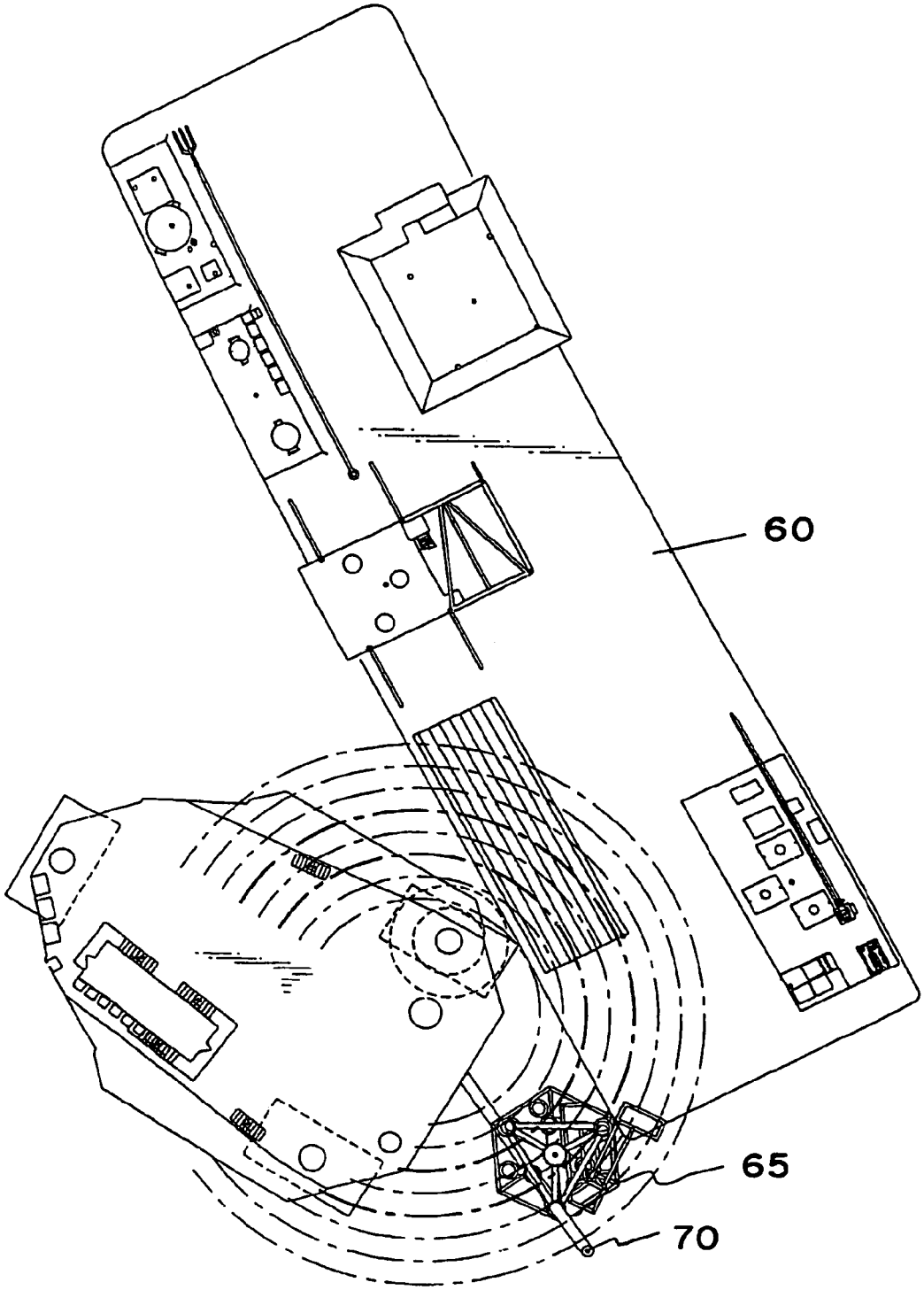
Figure 10:
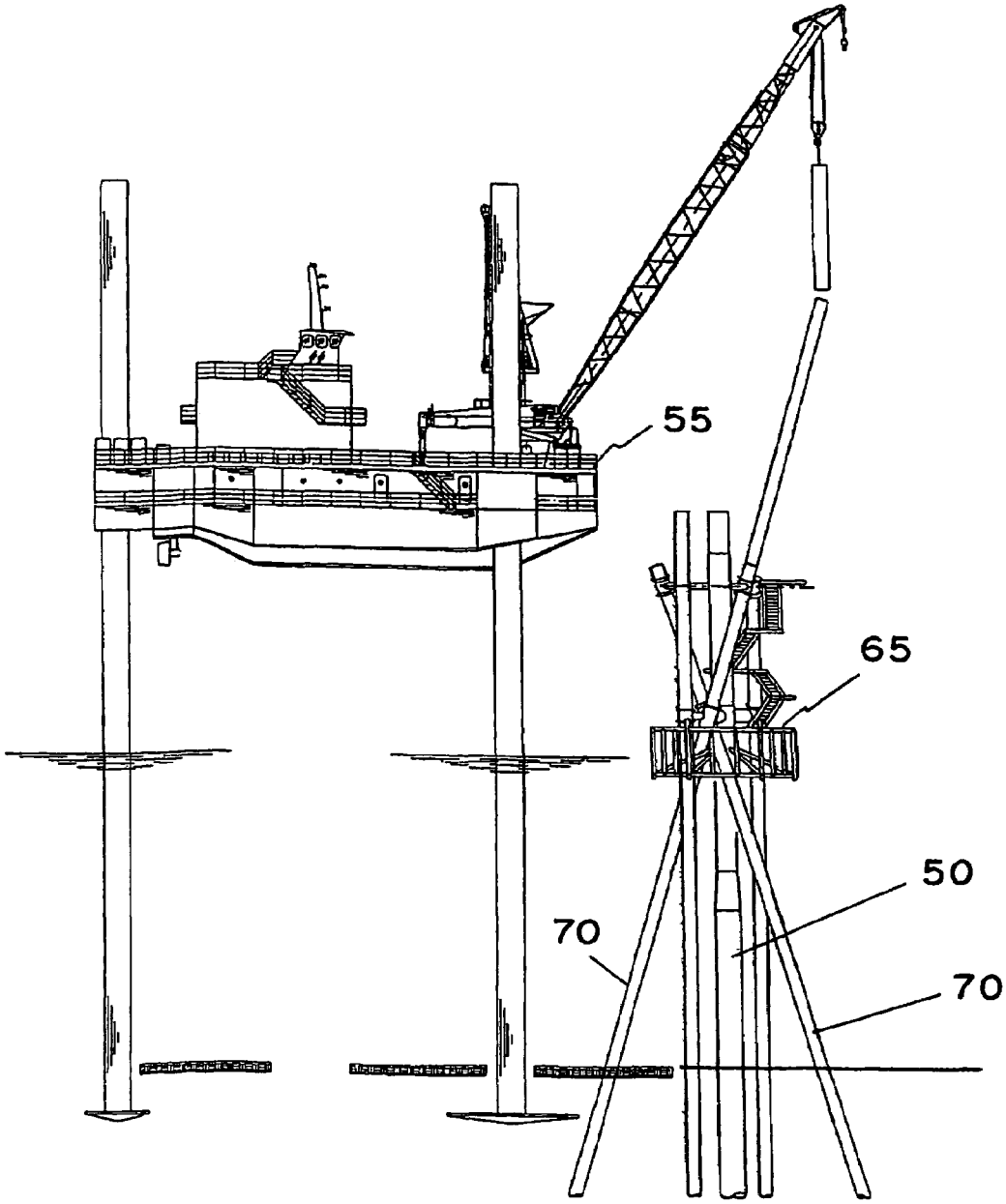

FIGS. 6–19 illustrate an exemplary method for assembling a structure in accordance with an exemplary embodiment of this invention with, for example, a barge boat, around a SSC 50 (Self Sustaining Caisson). In this exemplary embodiment, the SSC has been installed by a drilling rig, such as a rig drilling an exploration well. In FIG. 6, the position, and orientation of the legs are determined and a lift boat 55 anchored and jacked-up relative to the installation point of the SSC. Next, as illustrated in FIG. 7, the jack-up orientation of the liftboat relative to the SSC is shown. Next, as illustrated in FIG. 8, the guide structure 65 is unloaded from the barge 60. Then, as illustrated in FIG. 9, the legs or piles 70, are unloaded, placed in the guide structure, and in FIG. 10, installed via the guide structure into, for example, the ocean floor with the aid of a hydraulic hammer. As can be seen from this illustration, the piles 70 intersect at a point just above the water line. This allows, for example, the piles and all associated connection to be made above water.

Figure 11:
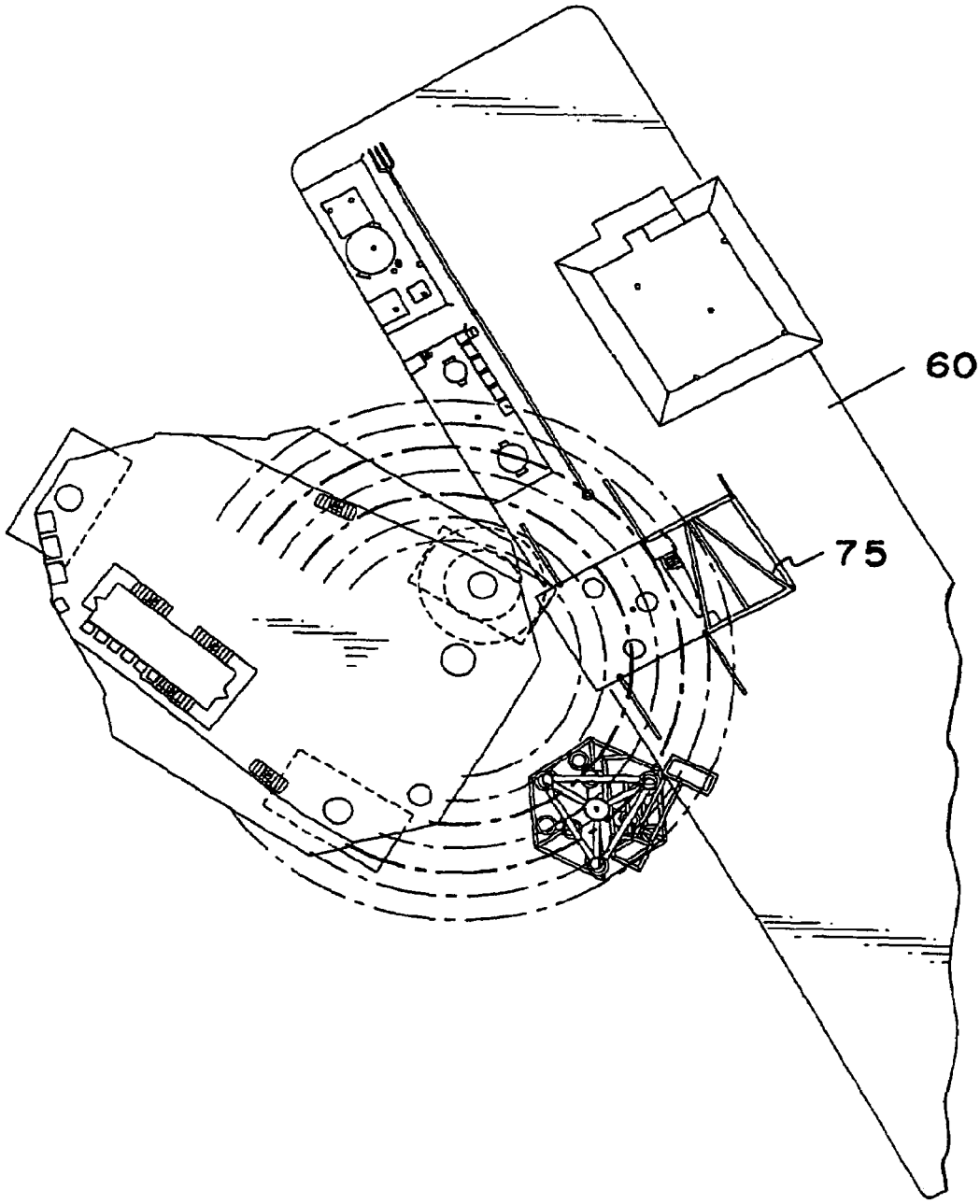
Figure 12:
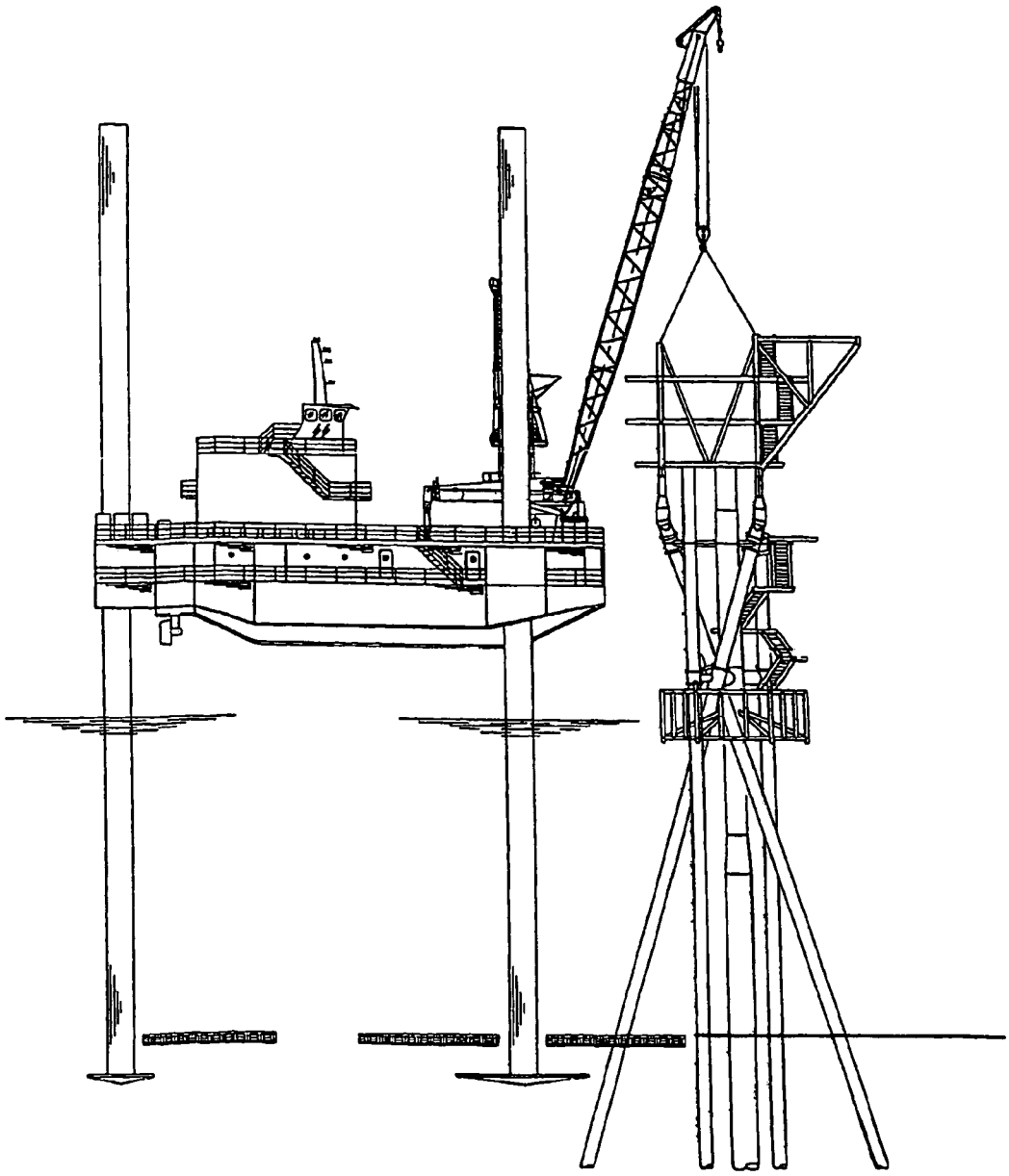
Figure 13:
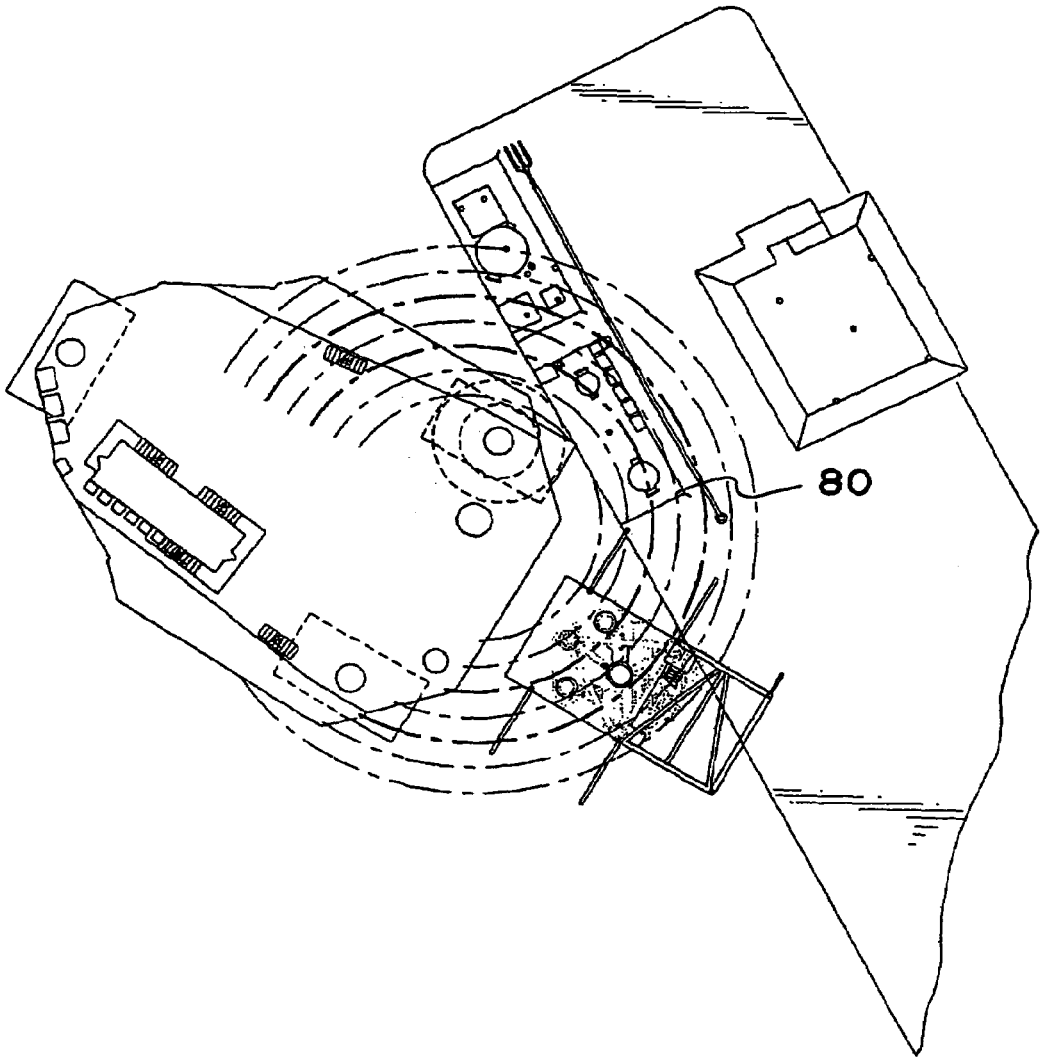
Figure 14:
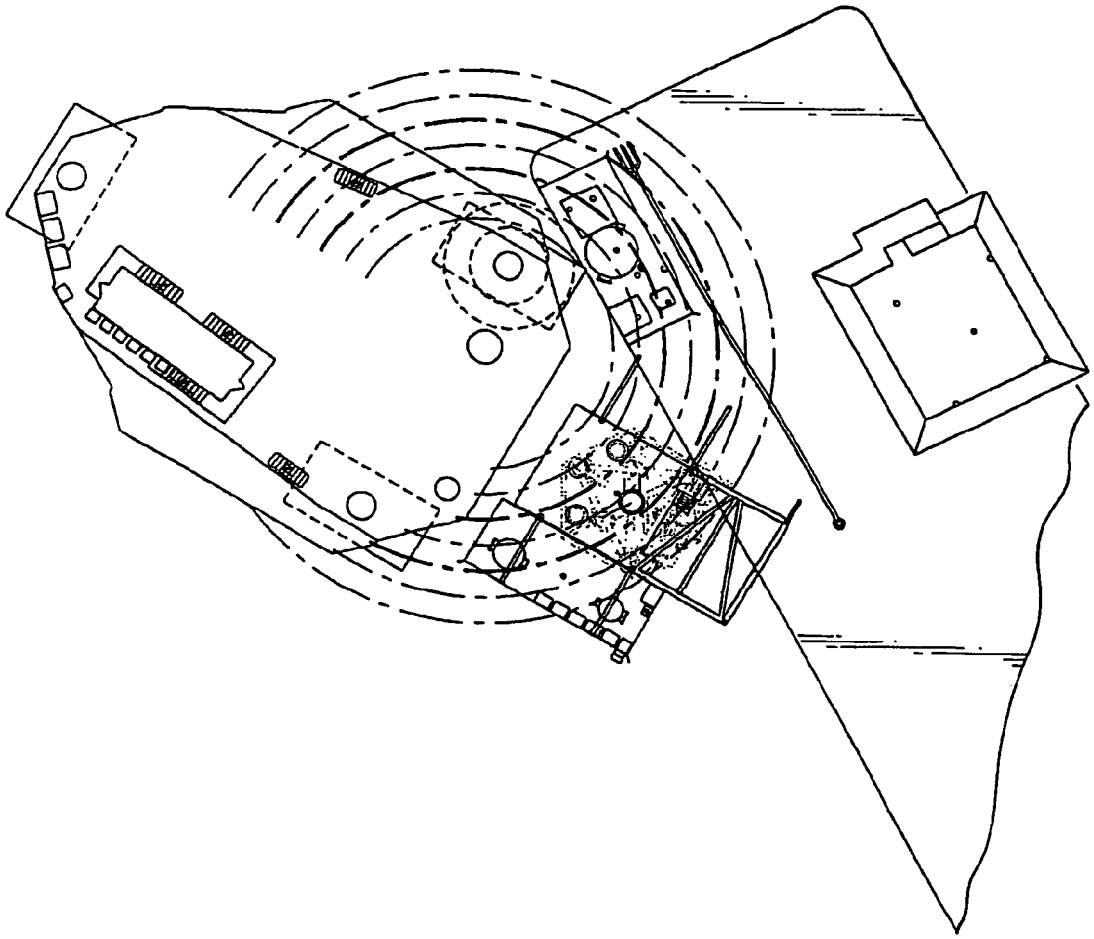
Figure 15:
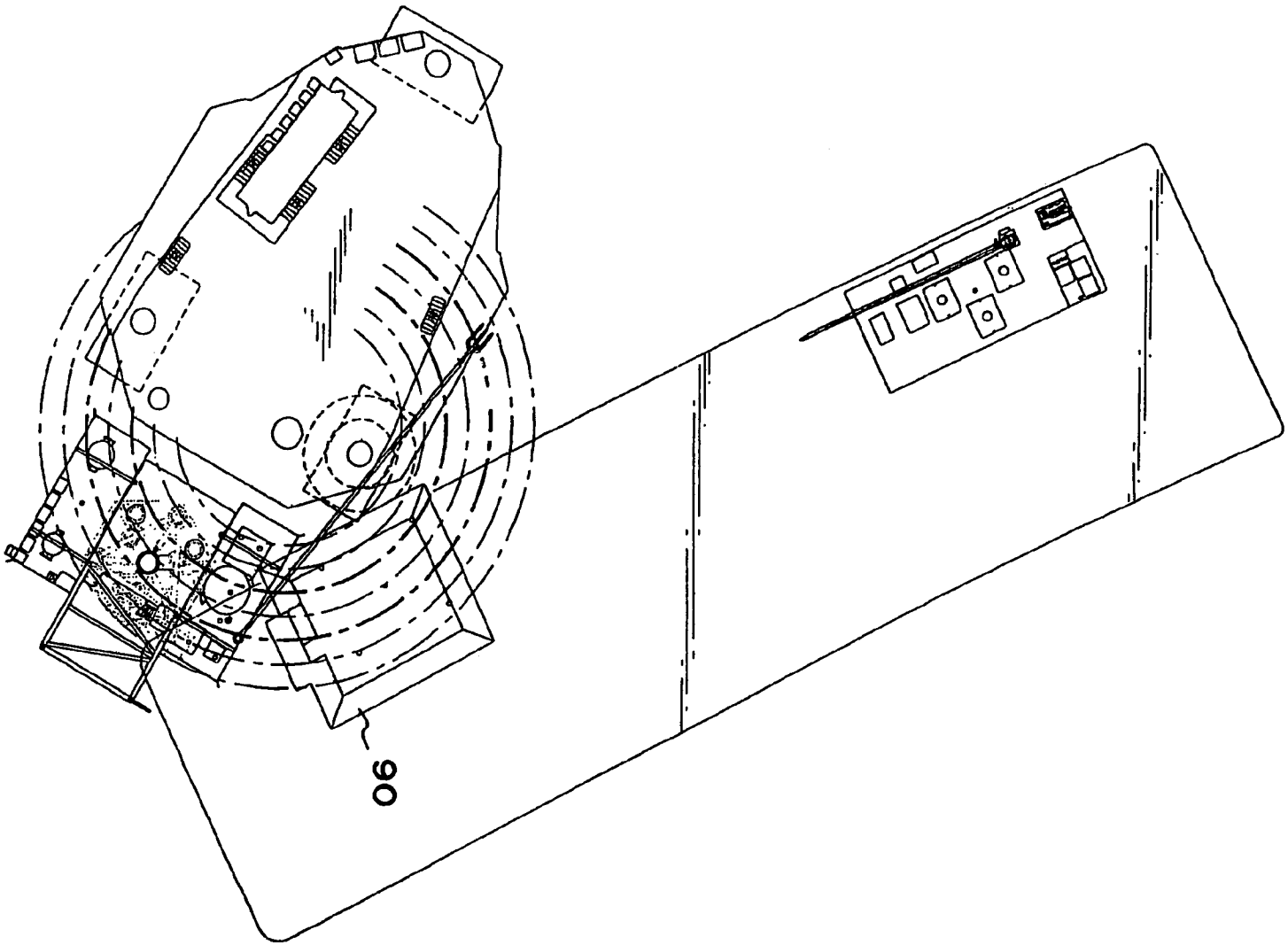
Figure 16:
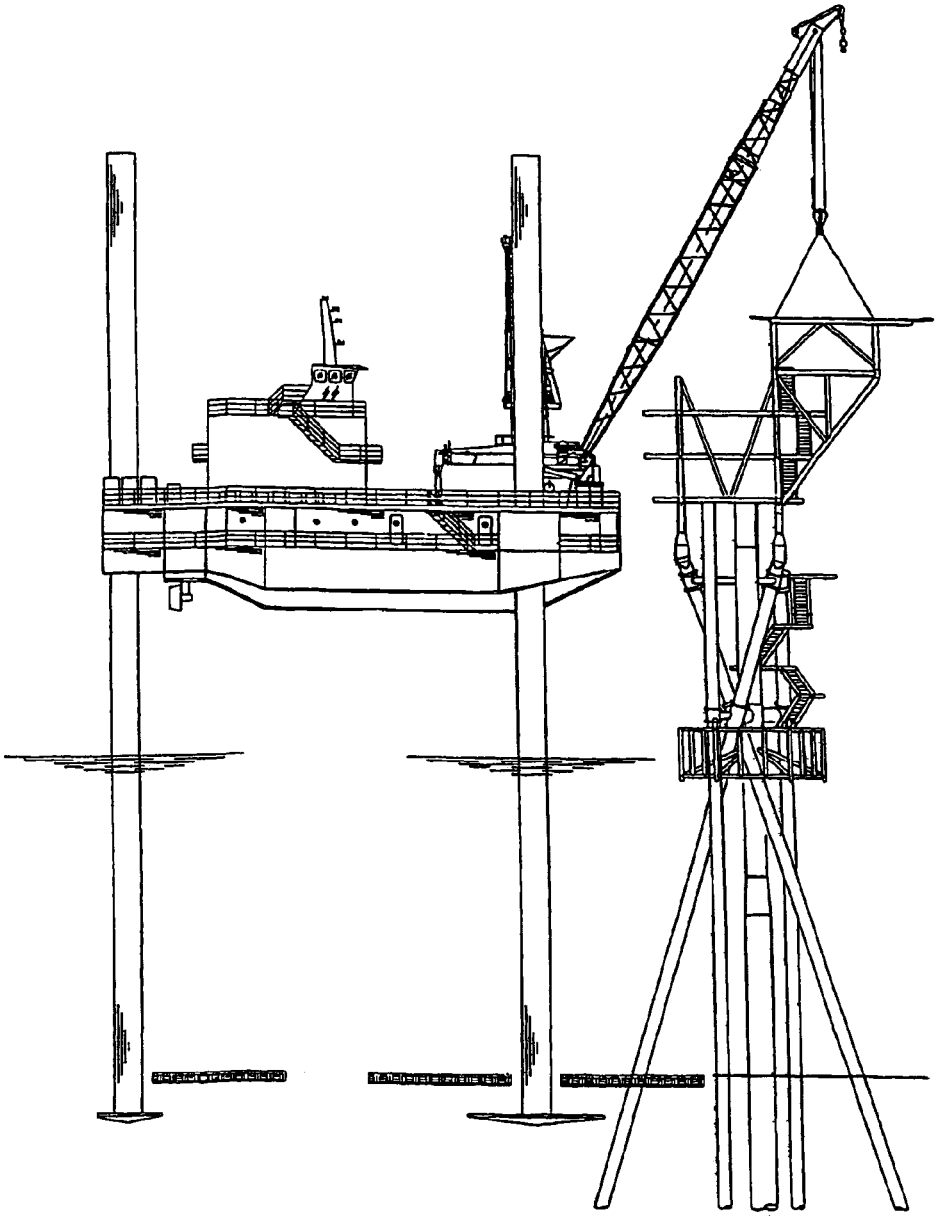
Figure 17:
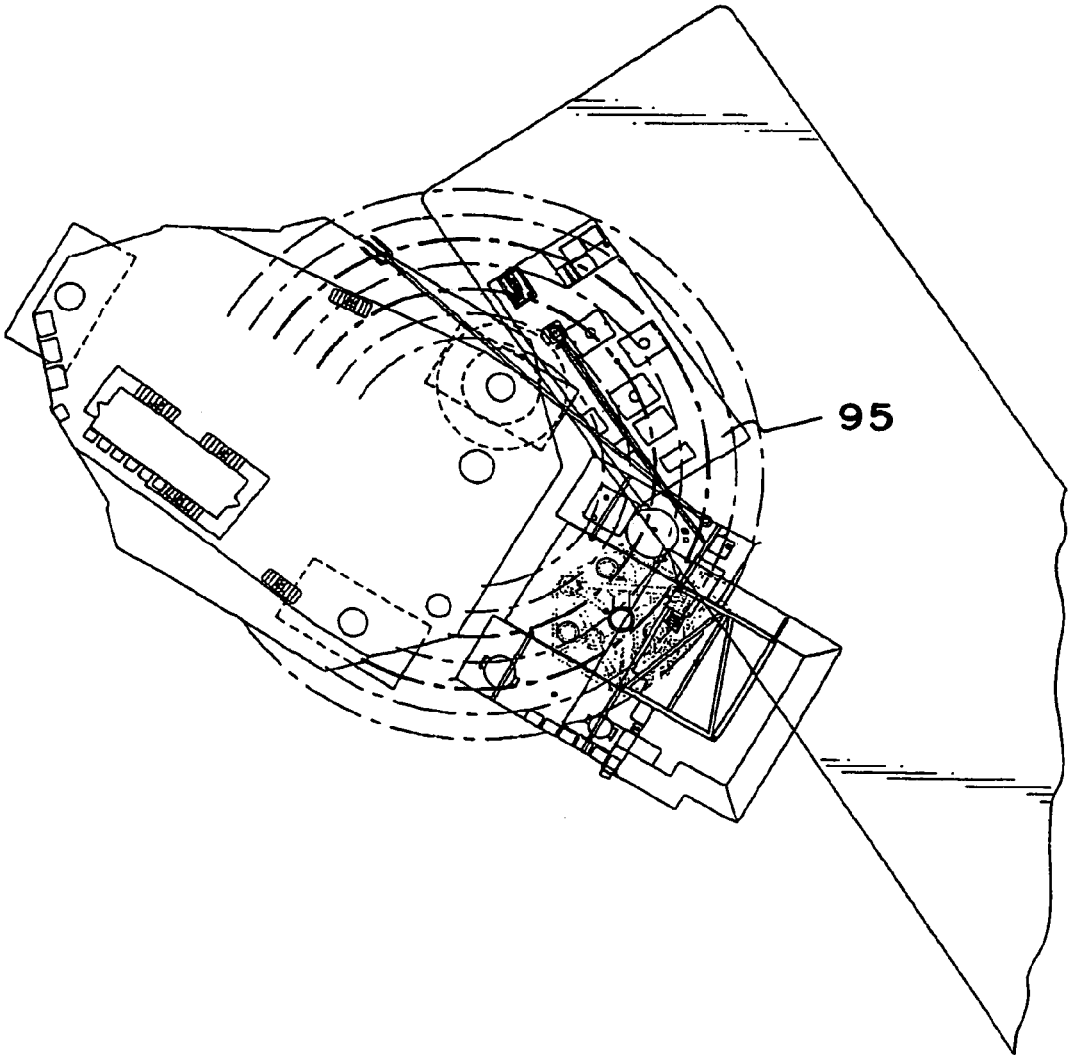
Figure 18:
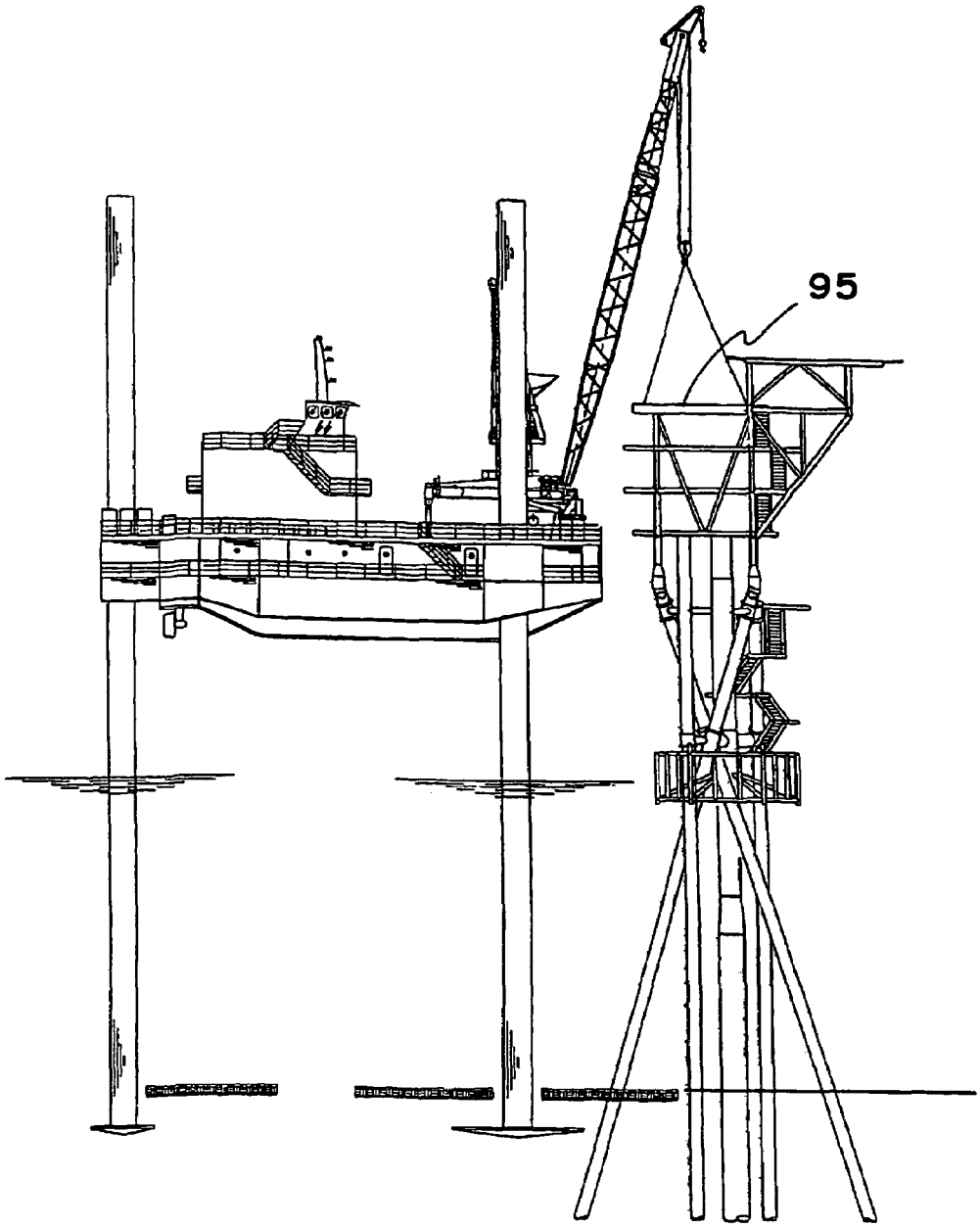

In FIG. 11, the barge 60 is relocated and the deck frame 75 is unloaded. In FIG. 12 the deck frame 75 installed on the piles. Next, in FIGS. 13–16, the southskid 80, northskid and ventroom 85, and helideck 90, respectfully, are unloaded from the barge and installed on the piles. In particular, FIG. 16 illustrates how the various portions of the rig are installed at an end of the piles above the intersection point, and thus above the water line. Then, in FIGS. 17–18, the main deck 95 unloaded and installed.

Figure 19:
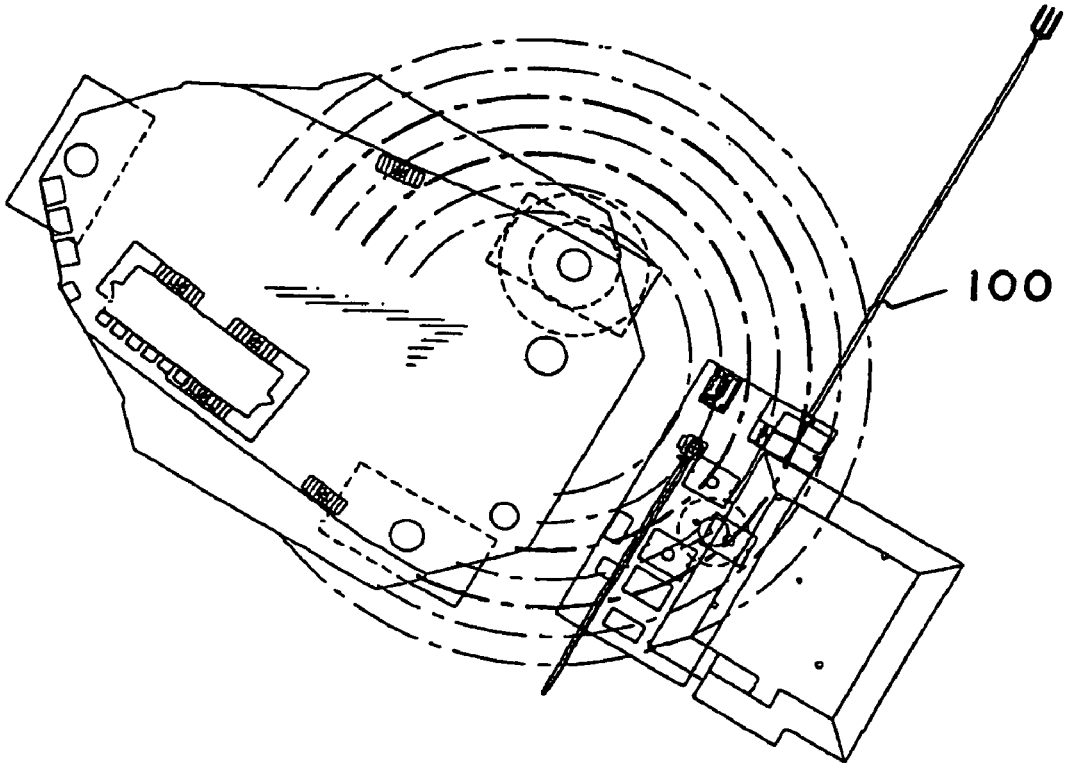
Figure 20:
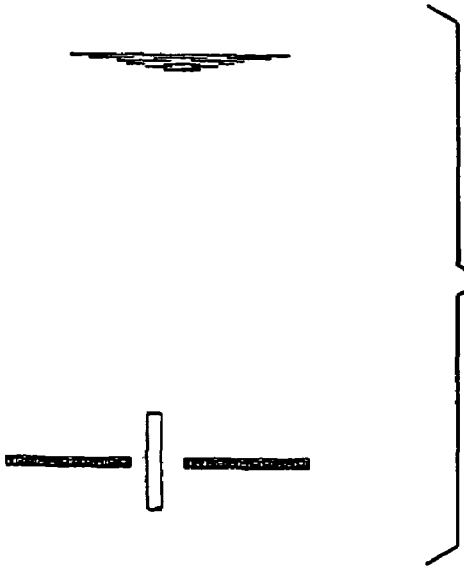
FIGS. 20–27 illustrate another exemplary method of assembling a caisson according to this invention.

FIG. 19 illustrates the completed rig where the barge has been unloaded and the vent boom 100 rotated into position.

Figure 21:
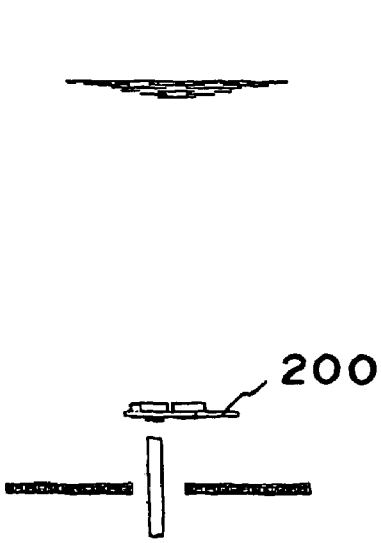
Figure 22:
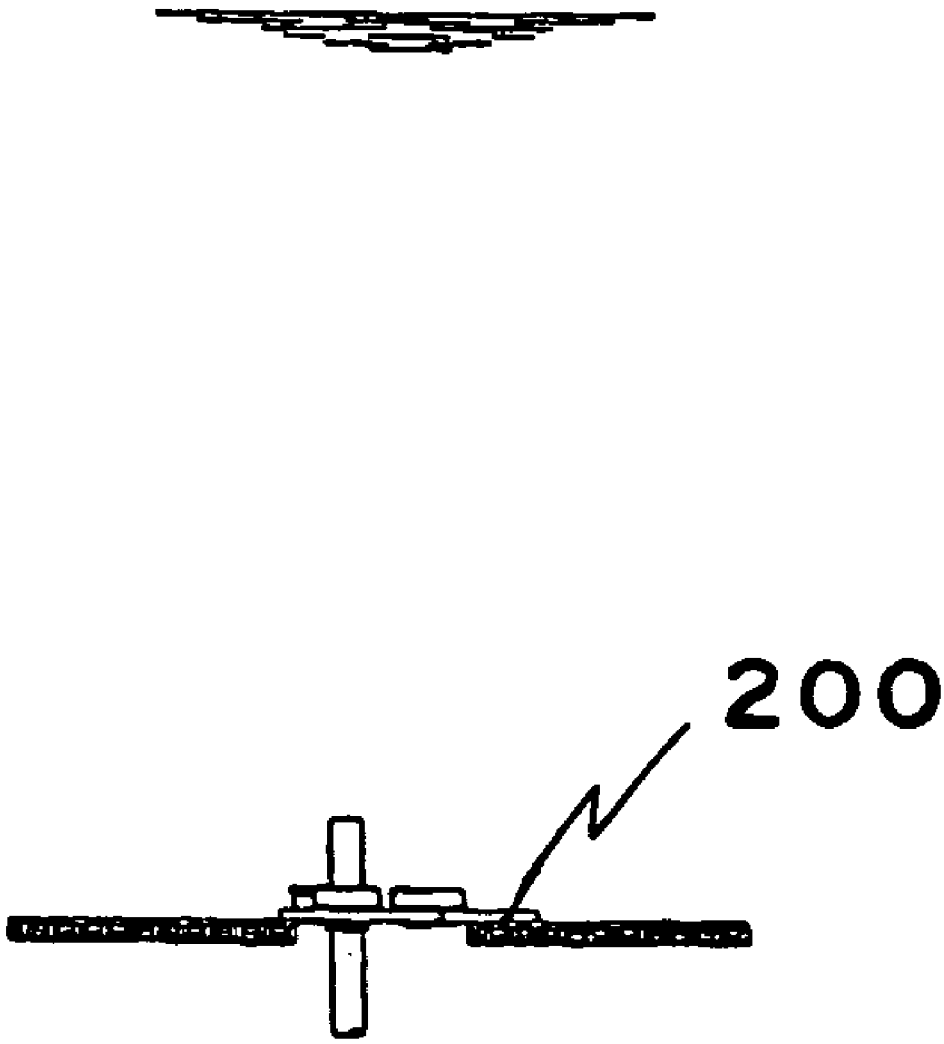

FIGS. 20–27 illustrate exemplary steps for constructing a structure support according to an alternative exemplary embodiment of this invention where a SSC is not initially present at a well head. In particular, this exemplary method utilizes a jack-up drilling rig and derrick barge to construct the rig. Specifically, in FIG. 20, a jack-up drilling rig is mobilized and the first conductor with a mudline suspension is drilled. Next, as illustrated in FIG. 21, the jack-up rig installs a sub-sea template 200 that is used as a guide structure for the well head and the subsequent installation of the SSC. Then, in FIG. 22, a second conductor with a mudline suspension is drilled and installed via the sub-sea template 200.

Figure 23:
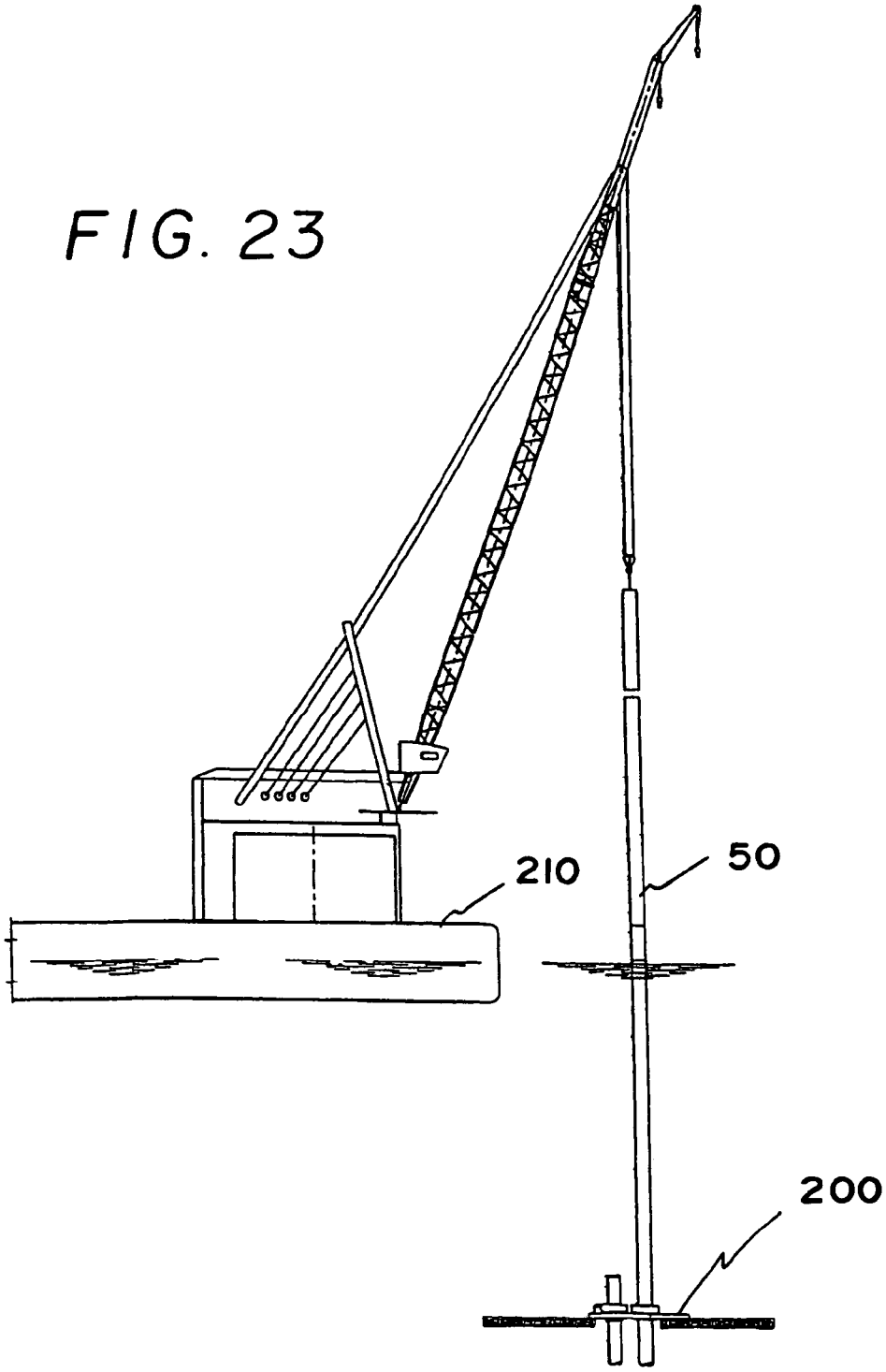
Figure 24:
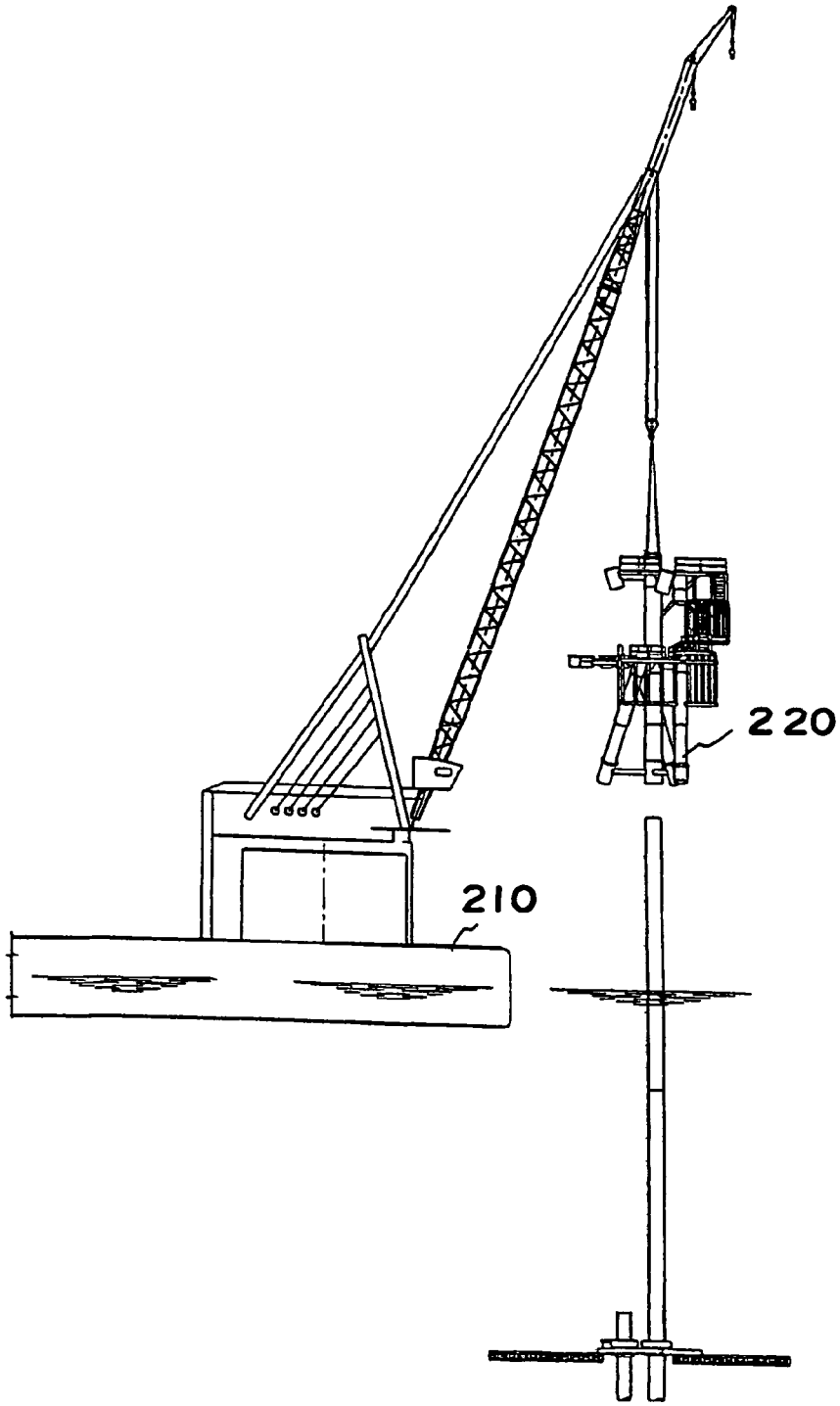
Figure 25:
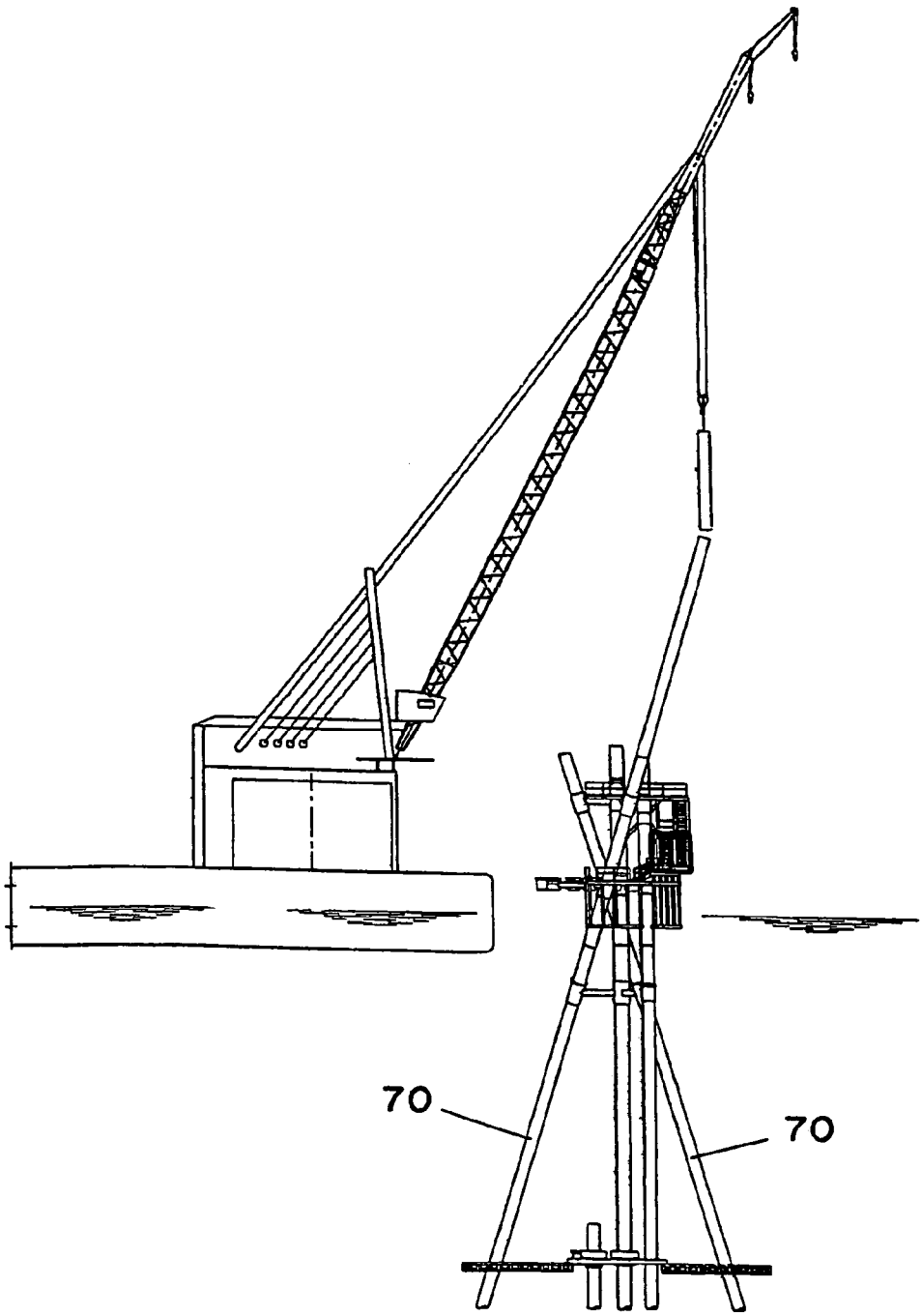
Figure 26:
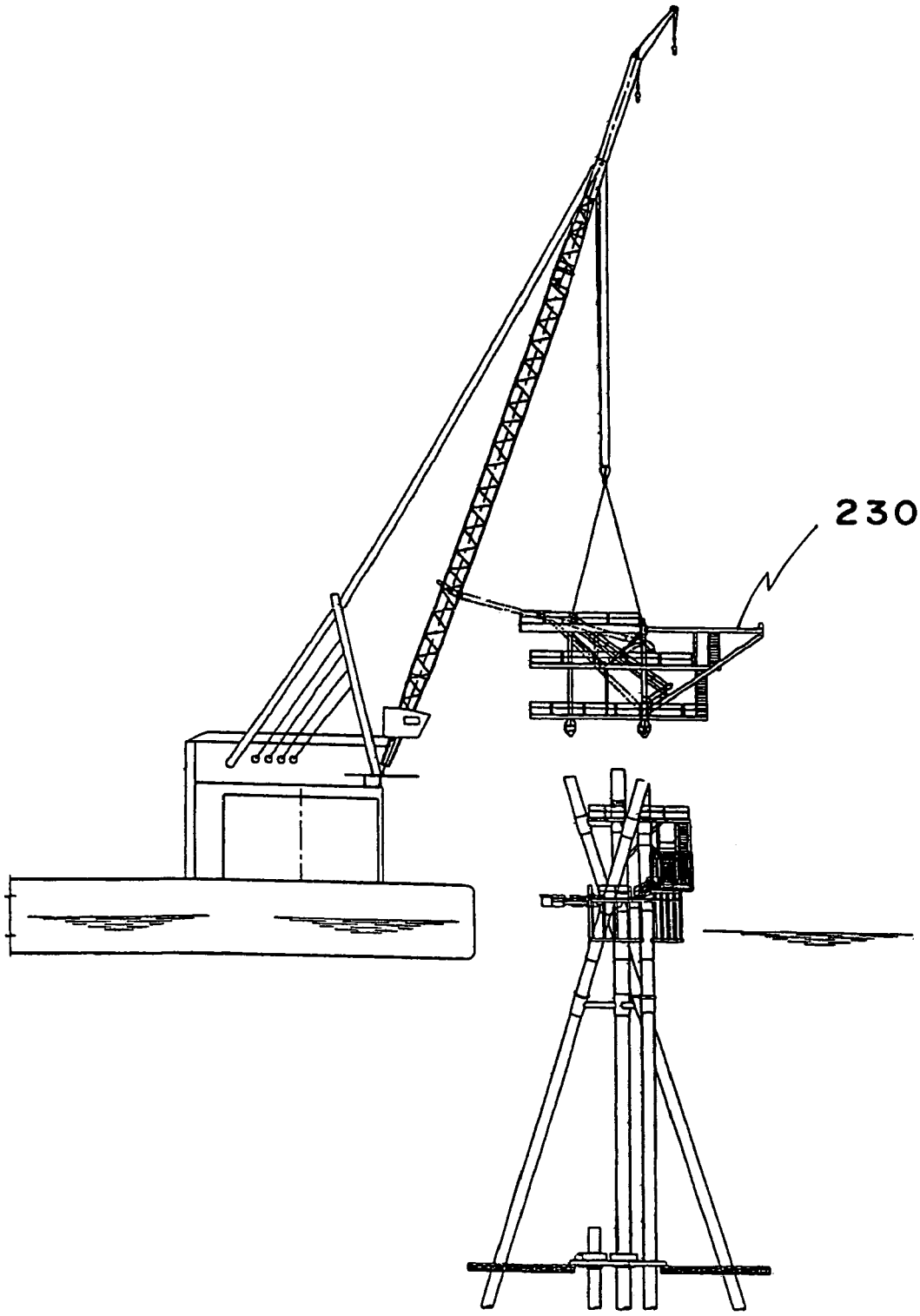
Figure 27:
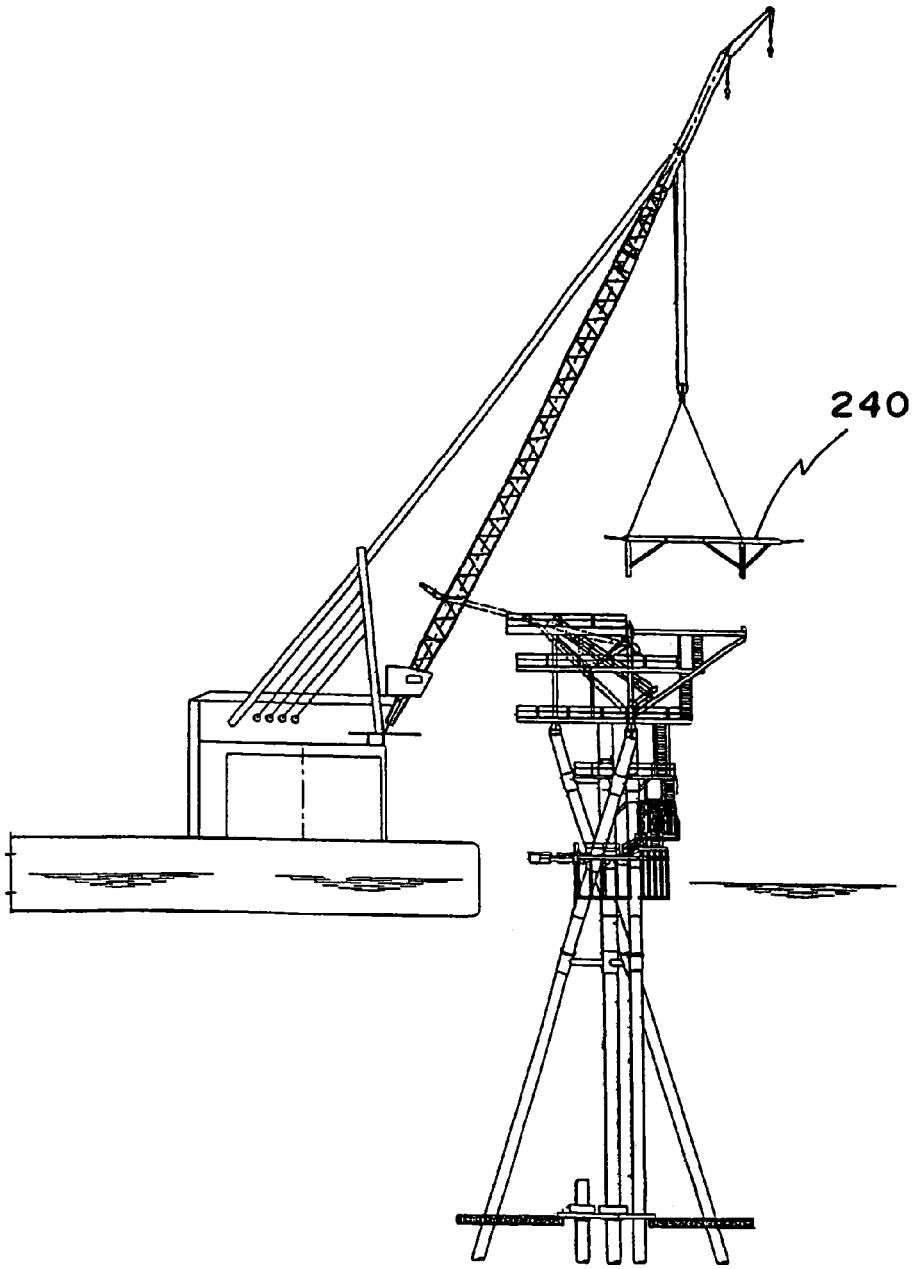

FIG. 23 illustrates the installation of the caisson by, for example, a derrick barge 210. Next as illustrated in FIG. 24, for example, the derrick barge 210 installs the inward batter guide structure 220. Then, as illustrated in FIG. 25, the piles 70 are installed. FIG. 26 illustrates the installation of the deck frame 230 and FIG. 27 the helideck 240.

It is, therefore, apparent that there has been provided, in accordance with the present invention, a support and method for assembling the support to support a structure. While this invention has been described in conjunction with a number of illustrative embodiments, it is evident that many alternatives, modifications, and variations would be or are apparent to those of ordinary skill in the applicable arts. Accordingly, the disclosure is intended to embrace all such alternatives, modifications, equivalents and variations that are within in the spirit and scope of this invention.

What is claimed is:

1. A method of constructing a drilling rig support comprising the steps of:

providing at least three legs in a teepee configuration;

placing a first end of the first three legs on a mounting surface; and affixing a drilling rig to a second end of the at least three legs, wherein the three legs are unitary structures from the first end to the second end, and wherein the drilling rig is located at a position above an intersecting point of the at least three legs.

2. The method of claim 1, further comprising the step of drilling a well bore with the drilling rig.

3. The method of claim 2, further comprising the step of producing a hydrocarbon product through the well bore.

4. The method of claim 1, further comprising the step of providing an angular guide structure to orient the at least three legs.

5. The method of claim 4, wherein the angular guide structure is positioned at said intersecting point.

* * * * *